US006582343B2

(12) United States Patent
Lin et al.

(10) Patent No.: US 6,582,343 B2
(45) Date of Patent: Jun. 24, 2003

(54) ADJUSTABLE STEP EXERCISER

(76) Inventors: David Lin, 4 Fl., No. 76, Ta-Hsin St., Yungho City, Taipei Hsien (TW); Chih-Liang Chen, No. 10, Lane 1431, Kuanghsing Rd., Pateh City, Taoyuan Hsien (TW)

( * ) Notice: Subject to any disclaimer, the term of this patent is extended or adjusted under 35 U.S.C. 154(b) by 201 days.

(21) Appl. No.: 09/761,063

(22) Filed: Jan. 16, 2001

(65) Prior Publication Data

US 2002/0094915 A1 Jul. 18, 2002

(51) Int. Cl.[7] ..... A63B 21/00
(52) U.S. Cl. ..... 482/53; 482/908
(58) Field of Search ..... 482/51, 52, 53, 482/57, 70, 908

(56) References Cited

U.S. PATENT DOCUMENTS 5,897,459 A * 4/1999 Habing et al. ..... 182/137
6,001,046 A * 12/1999 Chang ..... 482/57
6,135,927 A * 10/2000 Lo ..... 482/51
6,398,699 B1 * 6/2002 Yang ..... 482/142

* cited by examiner

*Primary Examiner*—Stephen R. Crow
(74) *Attorney, Agent, or Firm*—David A. Belasco; Belasco Jacobs & Townsley, LLP

(57) ABSTRACT

A step exerciser has a base, two pedal assemblies, a segmented vertical bar, a handle and a seat. The segmented vertical bar comprises an upper bar and a middle bar and is connected to the base. The handle is adjustably attached to the upper bar. The seat is foldably attached to the upper bar. With such an exerciser, the handle and the seat can be respectively adjusted relative to the upper bar, such that the step exerciser can be adjusted for use in different positions, and a user can use the step exerciser in a standing or a sitting position. The use of the step exerciser becomes more versatile.

14 Claims, 8 Drawing Sheets

ADJUSTABLE STEP EXERCISER

BACKGROUND OF THE INVENTION

1. Field of the Invention

The present invention relates to a step exerciser, and more particularly to an adjustable step exerciser that can be adjusted for use in different positions.

2. Description of Related Art

A conventional step exerciser exercises the legs of a user. However, the user can only operate the conventional step exerciser in a standing position. He or she easily feels bored after using the conventional step exerciser for a long time in the same position. The use of the conventional step exerciser is not versatile.

To overcome the shortcomings, the present invention tends to provide an adjustable step exerciser to mitigate or obviate the aforementioned problems.

SUMMARY OF THE INVENTION

The main objective of the invention is to provide a step exerciser that can be adjusted for use in different positions. The step exerciser has a base, two pedal assemblies, a sectional vertical bar, a handle and a seat. The sectional vertical bar is connected to the base and comprises an upper bar and a middle bar. The handle is adjustably attached to the upper bar. The seat is foldably attached to the upper bar. With such an exerciser, both the handle and the seat can be individually adjusted relative to the upper bar, such that the step exerciser can be configured for use in different positions, and a user can use the step exerciser in a standing or a sitting position. The use of the step exerciser becomes more versatile.

Other objects, advantages and novel features of the invention will become more apparent from the following detailed description when taken in conjunction with the accompanying drawings.

DETAILED DESCRIPTION OF PREFERRED EMBODIMENT

Figure 1:
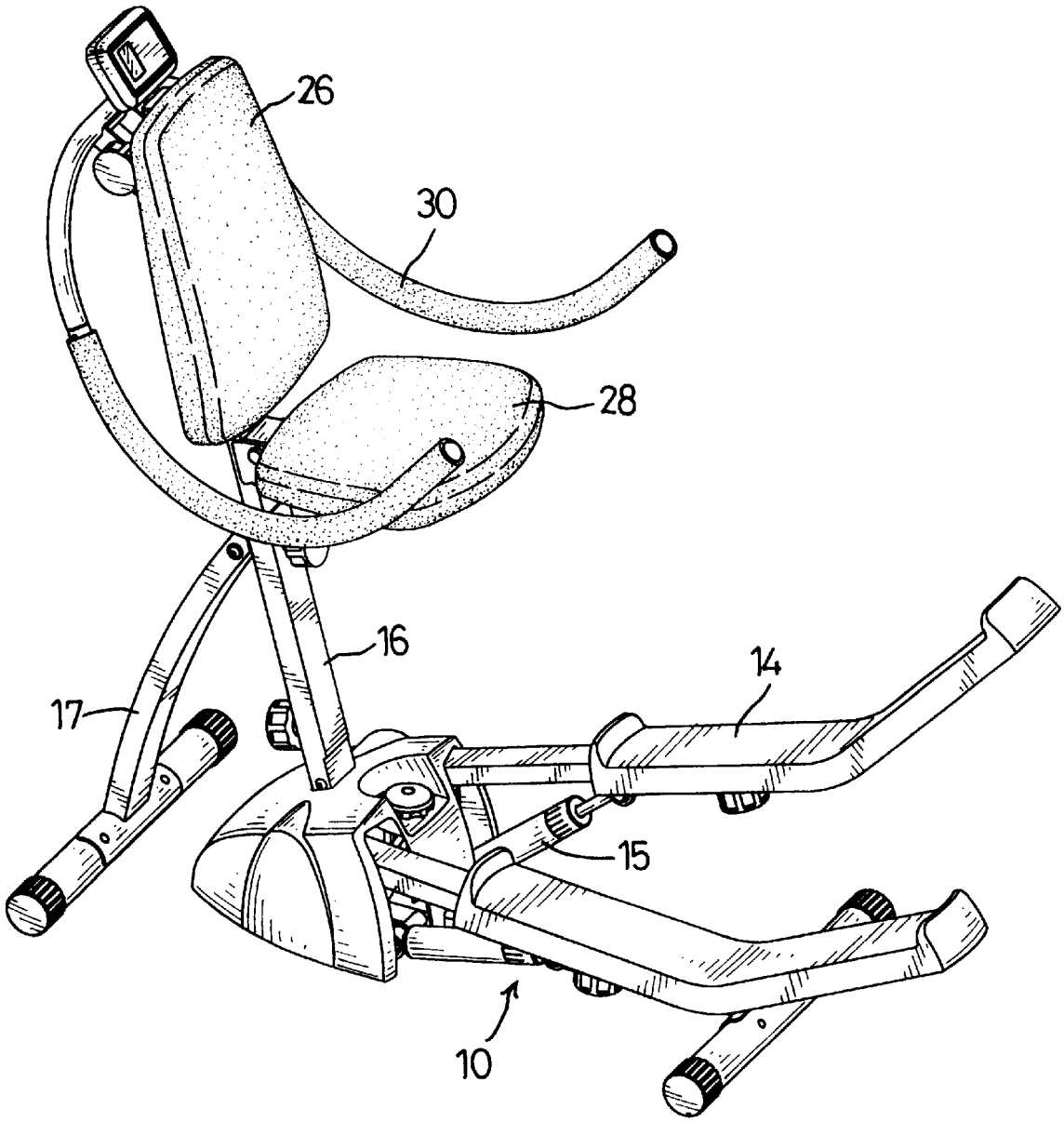
FIG. 1 is a perspective view of a step exerciser in accordance with the present invention configured for operation in a sitting position.
Figure 2:
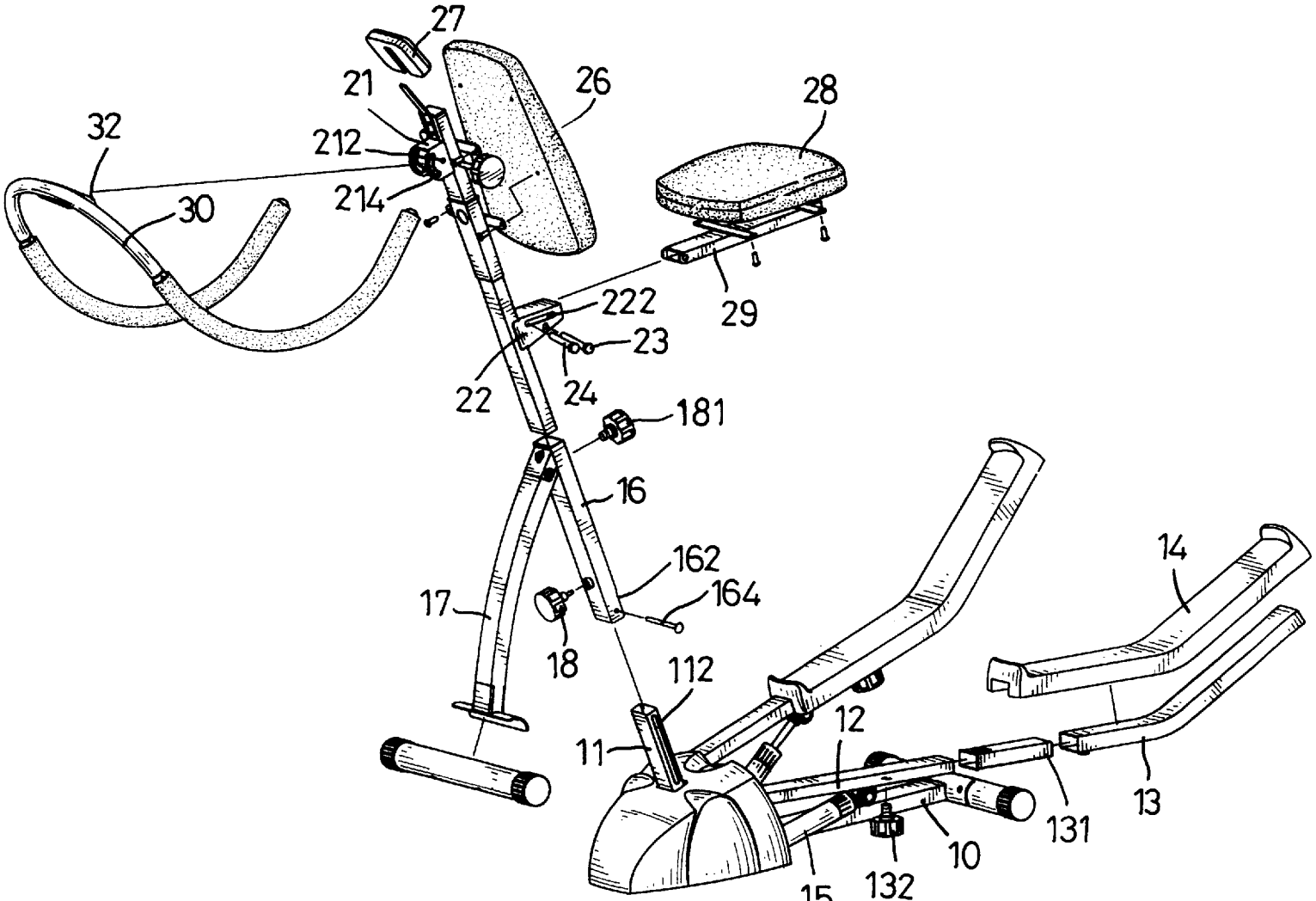
FIG. 2 is an exploded perspective view of the step exerciser in FIG. 1.
Figure 6:
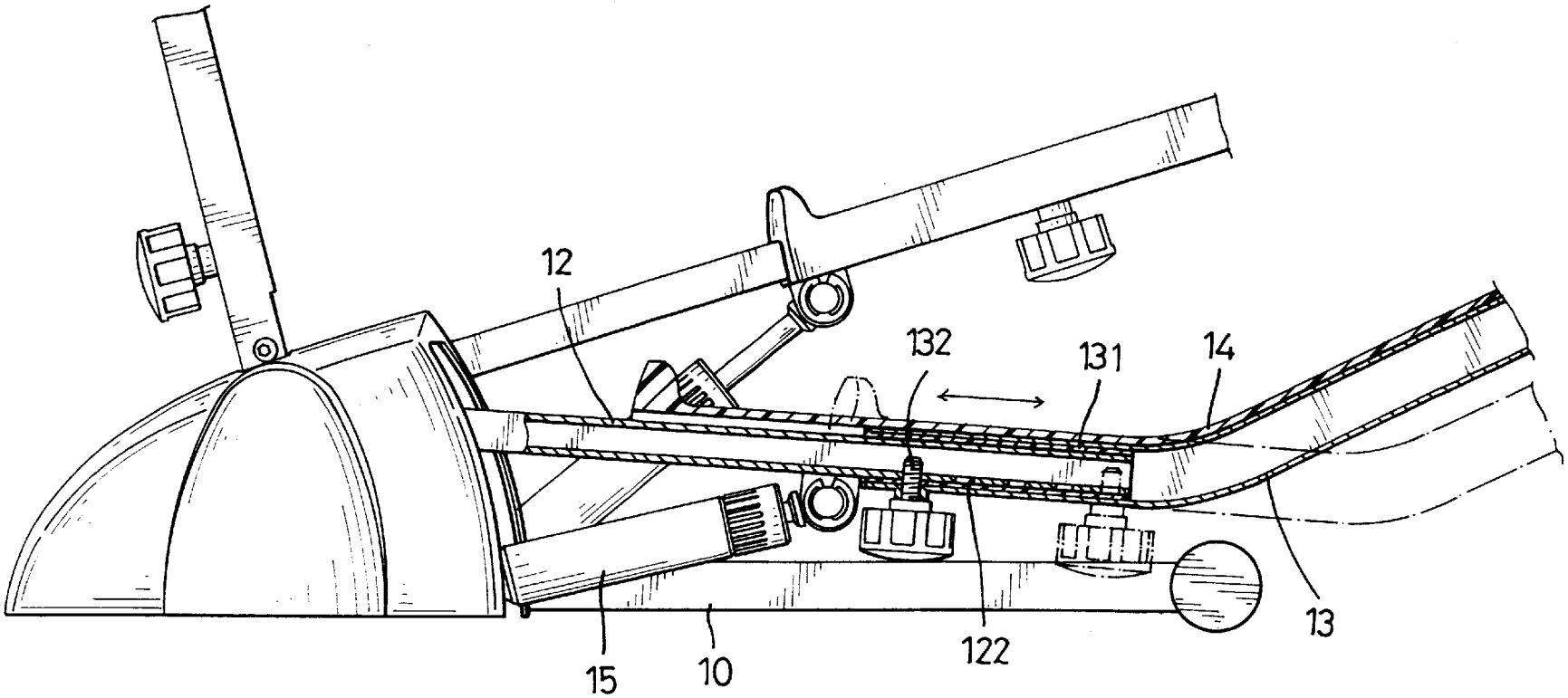
FIG. 6 is side plan view in partial section of the pedal section of the step exerciser in FIG. 1 showing the pedal being moved relative to the pedal bar.

With reference to FIGS. 1 and 2, a step exerciser in accordance with the present invention comprises a base (10), two pedal assemblies, a sectional vertical bar, a handle (30) and a seat (28). The base (10) has a T-shaped foot extending from the base (10) parallel to the ground to stabilize the base (10) on the ground. Each pedal assembly is comprised of a pedal bar (12), a sleeve (13) with adjusting knob (132), a pedal (14) and a damper (15). Each pedal bar (12) is pivotally connected to the base (10) and has multiple threaded holes (122) defined on the underside of the pedal bars (12). A damper (15) is pivotally connected between the base (10) and each of the pedal bars (12). With reference to FIGS. 2 and 6, a sleeve (13) with a through hole defined near the end of the sleeve (13) is attached to each pedal bar (12). Each pedal (14) is bent and pressed onto each sleeve (13) for the user to step on. An adjusting knob (132) is attached to a bolt that extends through the through hole in each sleeve (13) and screws into one of the thread holes (122) defined in the corresponding pedal bar (12). The sleeve (13) and the pedal (14) are held in place on the corresponding pedal (12) by the adjusting knob (132). When the adjusting knob (132) is unscrewed from the threaded hole (122), the sleeve (13) and the pedal (14) can slide along the corresponding pedal bar (12) and align with a different threaded hole (122). The position of the pedal (14) on the corresponding pedal bar (12) is adjustable. In addition, a shim (131) is mounted between each pedal bar (12) and the corresponding sleeve (13) to fill the gap defined between the pedal bar (12) and the sleeve (13).

Figure 7:
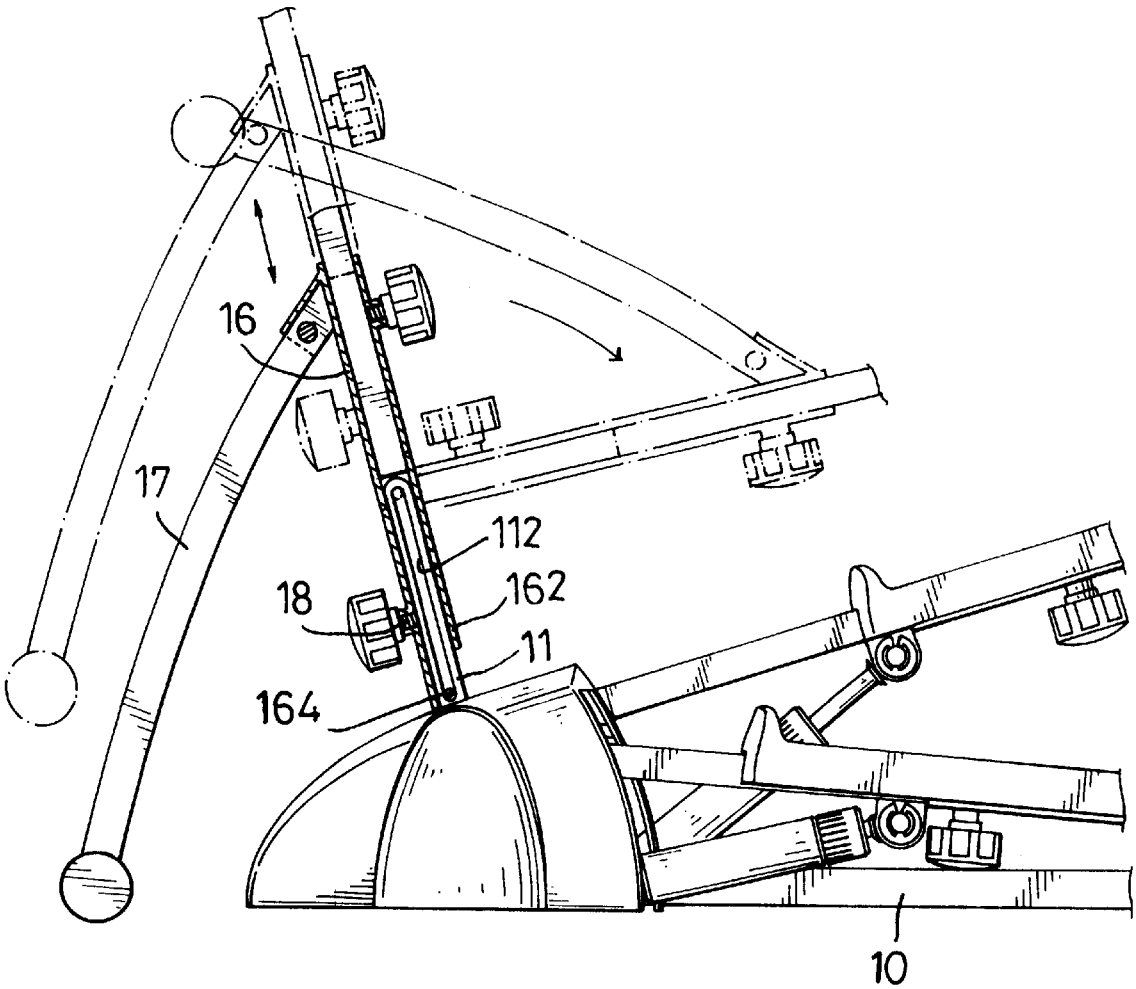
FIG. 7 is a side plan view in partial section of the base section of the step exerciser in FIG. 1 showing the middle bar being pivoted relative to the base to fold the step exerciser.

With reference to FIGS. 2 and 7, the sectional vertical bar comprises an upper bar (20) and a middle bar (16) and is connected to a bottom bar (11) that extends up from the base (10). The middle bar (16) slides on the uppermost end of the bottom bar (11). A fastening knob (18) with a bolt is screwed into the middle bar (16) and presses against the bottom bar (11), such that the middle bar (16) can be securely attached to the bottom bar (11) at any desired position. The upper bar (20) is securely connected to the uppermost end of the middle bar (16) with another fastening knob (181). A support bar (17) with a T-shaped foot on the end of the support bar (17) is connected to the middle bar (16), and a lower end of the T-shaped foot abuts the ground. The supporting bar (17) provides stability to the step exerciser. A display (27) is attached to the uppermost end of the upper bar (20) to present information to the user.

Figure 8:
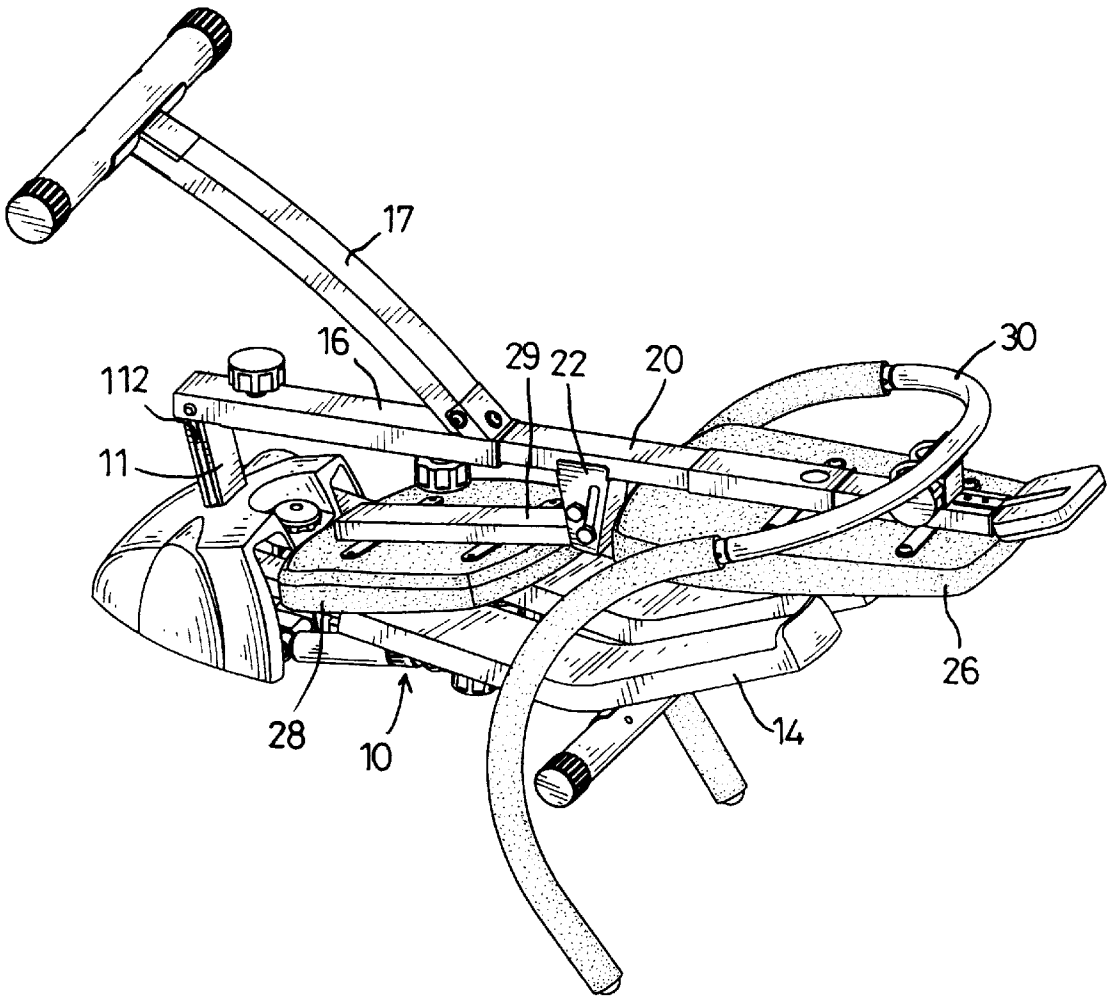
FIG. 8 is a perspective view of the step exerciser in accordance with the present invention folded for storage.

To allow the middle bar (16) to be folded relative to the bottom bar (11), an elongated hole (112) is longitudinally defined in the bottom bar (11). A pivot pin (164) extends through the middle bar (16) and the elongated hole (164). A notch (162) is defined in one side of the lowermost end of the middle bar (16). When the fastening knob (18) is loosened, the middle bar (16) can be moved up relative to the bottom bar (11) along the elongated hole (112). When the middle bar (16) is moved to a position where the notch (164) faces the uppermost end of the bottom bar (11), the middle bar (16) can be pivoted relative to the bottom bar (11). Consequently, the step exerciser is folded into a small package as shown in FIG. 8. The storage and transportation of the step exerciser is easier.

Figure 3:
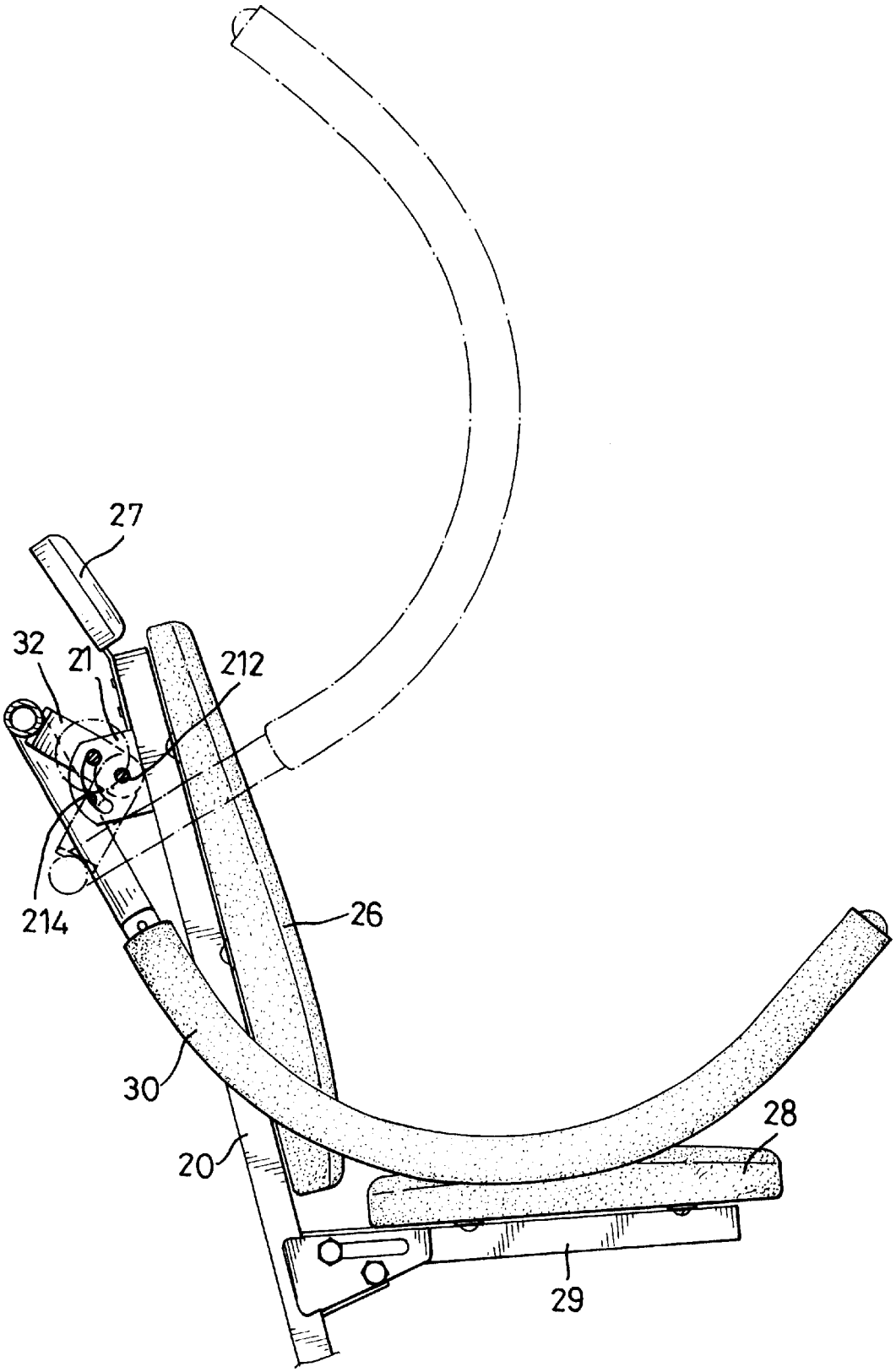
FIG. 3 is an operational side plan view of the handle section of the step exerciser in FIG. 1 showing the handle being adjusted relative to the upper bar.

With reference to FIGS. 2 and 3, the handle (30) is pivotally connected to the upper bar (20). A pivot bracket (21) is attached to the upper bar (20). A central hole (212) is defined in the pivot bracket (21). An arcuate hole (214) is defined in the pivot bracket (214) with the central hole (212) at the center of curvature. A pivoting frame (32) is attached to the handle (30). A first bolt extends through the pivoting frame (32) and the central hole (212) in the pivot bracket (21), and a first nut screws onto the first bolt. A second bolt extends through the pivoting frame (32) and the arcuate hole (214) in the pivot bracket (21), and a second nut screws tightly onto the second bolt. Consequently, the handle (30) is held in position relative to the upper bar (20). When the second bolt is loosened, the handle (30) can pivot relative to the upper bar (20) as the second bolt moves along the arcuate hole (214) to adjust the position of the handle (30) relative to the upper bar (20).

Figure 4:
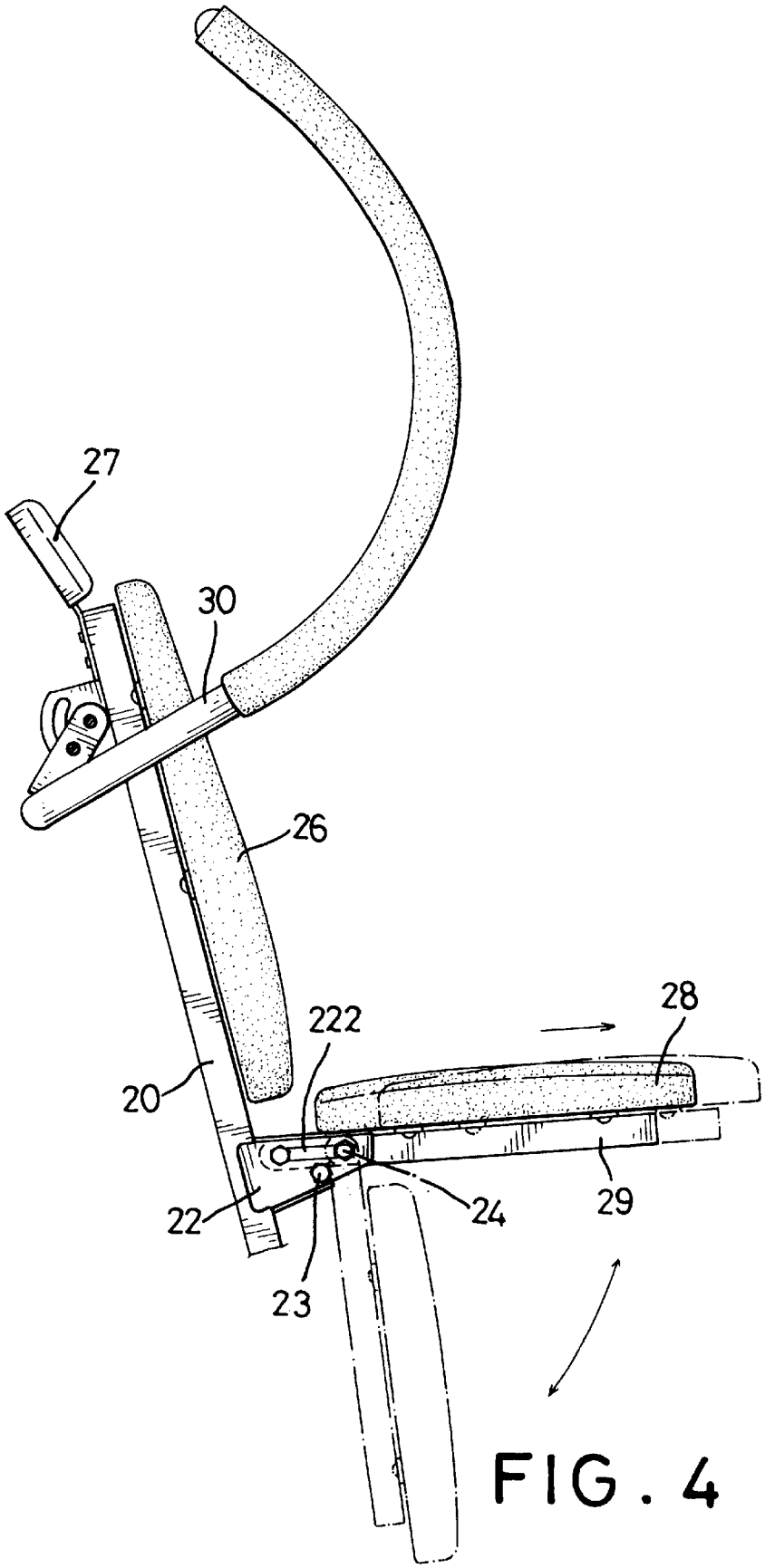
FIG. 4 is an operational side plan view of the seat section of the step exerciser in FIG. 1 showing the seat being folded relative to the upper bar.
Figure 5:
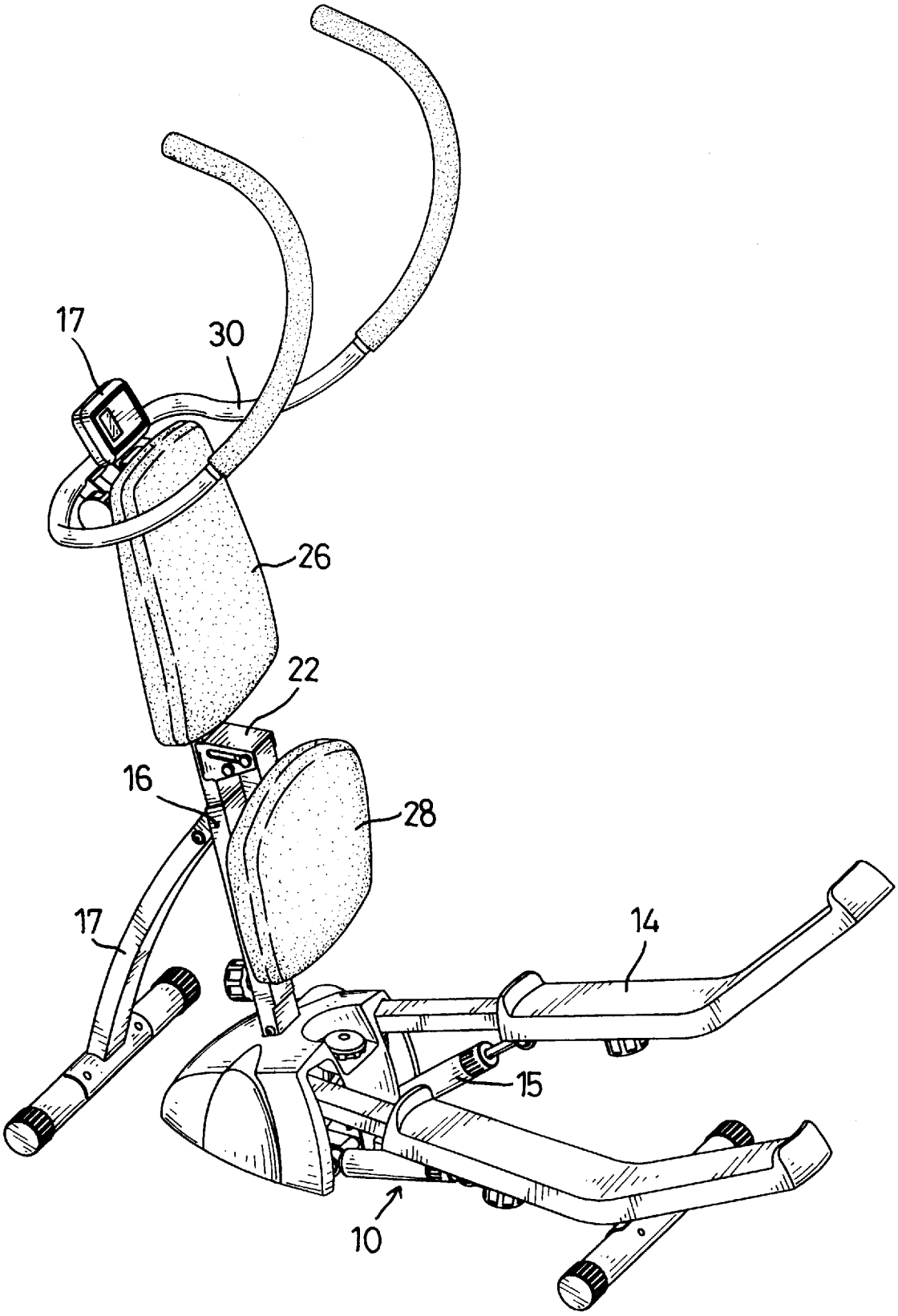
FIG. 5 is a perspective view of the step exerciser in accordance with the present invention configured for operation in a standing position.

With reference to FIGS. 2 and 4, the seat (28) is foldably connected to the upper bar (20). A bracket (22) is secured to the upper bar (20). A lateral slot (222) is defined through the bracket (22). A support (29) is mounted on the bottom of the seat (28) and inserted into the bracket (22). A pivot pin (24) extends through the slot (222) in the bracket (22) and the support (29) and has a nut screwed on one end. The nut on the pivot pin (24) is tightened enough to positively hold the pivot pin (24) in a specified position. The support (29) is securely attached to the bracket (22) by the pivot pin (24) with the nut. Further, a support pin (23) extends through the bracket (22) and holds the support (29) at a position far away from the pivot pin (24). The support pin (23) keeps the seat (28) from pivoting relative to the pivot pin (24) when a user sits on the seat (28). Consequently, the seat (28) will not unexpectedly pivot relative to the bracket (22) due to the support of the support pin (23). In addition, a backrest (26) is attached to the upper bar (20) to support the back of the user sitting on the seat (28).

With reference to FIGS. 1 to 4, when the seat (28) is positioned in a lateral position relative to the upper bar (20), the user can sit on the seat (20) and operate the step exerciser in a sitting position. With reference to FIGS. 2 to 5, when the nut on the pivot pin (24) is loosened, the support (29) can slide along the slot (222) relative to the bracket (22). When the free end of the support (29) passes over the support pin (23), as shown in the phantom lines in FIG. 4, the seat (28) with the support (29) can pivot relative to the bracket (22). The seat (28) will fold parallel to the upper bar (20), such that the user can operate the step exerciser in a standing position without interference from the seat (28). Consequently, the step exerciser can be adjusted for different types of use according to the user's needs. The use of the step exerciser becomes more versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fall extent indicated by the broad general meaning of the terms in which the appended claims are expressed.

What is claimed is:

1. An adjustable step exerciser adapted for use in either a standing position or a sitting position, comprising:

a base;

two pedal assemblies pivotally attached to the base;

a handle adjustably attached to the vertical bar;

a pivot bracket secured to the vertical bar, the pivot bracket comprising a central hole, an arcurate hole with the central hole at a center of curvature of the arcurate hole;

a pivoting frame secured to the handle;

a first bolt extending through the pivoting frame and the central hole in the pivot bracket, and a first nut threadingly engagable with the first bolt;

a second bolt extending through the pivoting frame and the arcurate hole in the pivot bracket, and a second nut threadingly engagable with the second bolt;

a bracket secured to the vertical bar, the bracket comprising a lateral slot defined through the bracket;

a support secured to the seat and slidably inserted into the bracket;

a pivot pin extending through the lateral slot in the bracket and the support is tightly securable in the slot with a nut;

a supporting pin extending into the bracket to hold the support; and a seat foldably attached to the vertical bar, whereby the handle is held in position relative to the upper bar by the bolts and nuts, and the seat and support are secured to the bracket by the pivot pin and the seat is held in position.

2. The step exerciser as claimed in claim 1, wherein each pedal assembly comprises a pedal bar with multiple threaded holes defined in a row in each pedal bar;

a damper pivotally connected between the base and each pedal bar;

a sleeve attached to each pedal bar;

a shim mounted between the pedal bar and the sleeve;

a bent pedal securely attached to each sleeve; and an adjusting knob with a bolt extending into each sleeve and screwed into one of the threaded holes defined in the corresponding pedal bar, thereby the sleeve and the pedal are held in position relative to the corresponding pedal bar by the adjusting knob.

3. The step exerciser as claimed in claim 1, wherein the vertical bar is comprised of an upper bar and a middle bar; and a bottom bar extends up from the base, wherein the middle bar is connected to an uppermost end of the bottom bar;

a first fastening knob with a bolt is screwed into the middle bar and presses against the bottom bar to securely attach the middle bar to the bottom bar;

the upper bar is securely connected to an uppermost end of the middle bar with a second fastening knob;

the handle and seat are attached to the upper bar; and a supporting bar is connected to the middle bar to provide stability to the middle bar.

4. The step exerciser as claimed in claim 3, wherein an elongated hole is longitudinally defined in the bottom bar;

a pivot pin extends through the middle bar and the elongated hole; and a notch is defined in one side of a lowermost end of the middle bar, thereby the middle bar is allowed to be folded relative to the bottom bar.

5. The adjustable step exerciser as claimed in claim 1 further comprising a backrest mounted on the vertical bar and above the seat.

6. An adjustable step exerciser comprising:

a base;

two pedal assemblies pivotally attached to the base;

a segmented vertical bar connected to the base and adjustable in height relative to the base;

a pivot bracket secured to the vertical bar and comprising a central hole defined in the pivot bracket, an arcurate hole defined in the pivot bracket with the central hole at the center of curvature of the arcurate hole;

a pivoting frame secured to the handle;

a first bolt extending through the pivoting frame and the central hole in the pivot bracket, and a first nut threadingly engagable with the first bolt;

a second bolt extending through the pivoting frame and the arcurate hole in the pivot bracket, and a second nut threadingly engagable with the second bolt; and a handle adjustably attached to an upper bar, thereby the handle is held in position relative to the upper bar by the bolts and nuts.

7. The step exerciser as claimed in claim 6, wherein each pedal assembly comprises a pedal bar with multiple threaded holes defined in a row in each pedal bar;

a damper pivotally connected between the base and each pedal bar;

a sleeve is attached to each pedal bar;

a shim mounted between the pedal bar and the sleeve;

a bent pedal securely attached to each sleeve; and an adjusting knob with a bolt extending into each sleeve and screwed into one of the threaded holes defined in the corresponding pedal bar, thereby the sleeve and the pedal are held in position relative to the corresponding pedal bar by the adjusting knob.

8. The step exerciser as claimed in claim 6, wherein wherein the vertical bar is comprised of an upper bar and a middle bar; and a bottom bar extends up from the base, wherein the middle bar is connected to an uppermost end of the bottom bar;

a first fastening knob with a bolt is screwed into the middle bar and presses against the bottom bar to securely attach the middle bar to the bottom bar;

the upper bar is securely connected to an uppermost end of the middle bar with a second fastening knob;

the handle and seat are attached to the upper bar; and a supporting bar is connected to the middle bar to provide stability to the middle bar.

9. The step exerciser as claimed in claim 8, wherein an elongated hole is longitudinally defined in the bottom bar;

a pivot pin extends through the middle bar and the elongated hole; and a notch is defined in one side of a lowermost end of the middle bar, thereby the middle bar is allowed to be folded relative to the bottom bar.

10. An adjustable step exerciser comprising:

a base;

two pedal assemblies pivotally attached to the base;

a segmented vertical bar connected to the base and adjustable in height relative to the base;

a bracket secured to the vertical bar and comprising a lateral slot defined through the bracket;

a seat foldably mounted on the segmented vertical bar;

a support secured to the seat and slidably inserted into the bracket;

a pivot pin extending through the slot in the bracket and the support and tightly secured in the slot with a nut; and a supporting pin extending into the bracket to hold the support;

whereby the seat and support are secured to the bracket by the pivot pin and the seat is held in position.

11. The step exerciser as claimed in claim 10, wherein each pedal assembly comprises a pedal bar with multiple threaded holes defined in a row in each pedal bar;

a damper pivotally connected between the base and each pedal bar;

a sleeve attached to on each pedal bar;

a shim mounted between the pedal bar and the sleeve;

a bent pedal securely attached to each sleeve; and an adjusting knob with a bolt extending into each sleeve and screwed into one of the thread holes defined in the corresponding pedal bar, thereby the sleeve and the pedal are positioned relative to the corresponding pedal bar by the adjusting knob.

12. The step exerciser as claimed in claim 10, wherein the vertical bar is comprised of an upper bar and a middle bar; and a bottom bar extends up from the base, wherein the middle bar is connected to an uppermost end of the bottom bar;

a first fastening knob with a bolt is screwed into the middle bar and presses against the bottom bar to securely attach the middle bar to the bottom bar;

the upper bar is securely connected to an uppermost end of the middle bar with a second fastening knob;

the handle and seat are attached to the upper bar; and a supporting bar is connected to the middle bar to provide stability to the middle bar.

13. The step exerciser as claimed in claim 12, wherein an elongated hole is longitudinally defined in the bottom bar;

a pivot pin extends through the middle bar and the elongated hole; and a notch is defined in one side of a lowermost end of the middle bar, thereby the middle bar is allowed to be folded relative to the bottom bar.

14. The adjustable step exerciser as claimed in claim 10, further comprising a backrest mounted on the vertical bar and above the seat.

* * * * *